US008238779B2

(12) United States Patent
Doshoda et al.

(10) Patent No.: US 8,238,779 B2
(45) Date of Patent: Aug. 7, 2012

(54) VOLATILE CHEMICAL SUBSTANCE CATCHING DEVICE AND ELECTRONIC APPARATUS

(75) Inventors: Hiroshi Doshoda, Osaka (JP); Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 523 days.

(21) Appl. No.: 12/468,257

(22) Filed: May 19, 2009

(65) Prior Publication Data

US 2009/0290897 A1 Nov. 26, 2009

(30) Foreign Application Priority Data

May 26, 2008 (JP) ..... 2008-136920

(51) Int. Cl.
*G03G 21/20* (2006.01)

(52) U.S. Cl. ..... 399/92; 399/93; 399/98

(58) Field of Classification Search ..... 399/92, 399/93, 98

See application file for complete search history.

(56) References Cited

U.S. PATENT DOCUMENTS

| | | | | |
|---|---|---|---|---|
| 5,091,880 | A | 2/1992 | Isono et al. | |
| 2003/0137794 | A1 | 7/2003 | Izumi et al. | |
| 2005/0271414 | A1 * | 12/2005 | Katayama et al. | 399/93 |

FOREIGN PATENT DOCUMENTS

| | | | |
|---|---|---|---|
| CN | 2873552 | Y | 2/2007 |
| JP | 2-203445 | A | 8/1990 |
| JP | 2002-365986 | A | 12/2002 |
| JP | 2003-284766 | A | 10/2003 |
| JP | 2004-137593 | A | 5/2004 |
| JP | 2005-055515 | | 3/2005 |
| JP | 2006-095429 | A | 4/2006 |
| JP | 2006-215308 | A | 8/2006 |
| JP | 2007-047496 | | 2/2007 |
| JP | 2007-279524 | A | 10/2007 |

* cited by examiner

*Primary Examiner* — Walter L Lindsay, Jr.

*Assistant Examiner* — Barnabas Fekete

(74) *Attorney, Agent, or Firm* — Nixon & Vanderhye P.C.

(57) ABSTRACT

A color multifunction printer of the present invention includes a volatile chemical substance catching device, provided in an exhaust duct provided above a fixing unit, which generates an electric field in an atmosphere with use of an electric-field generating and catching member, which attracts volatile chemical substances contained in the atmosphere to a surface of the electric-field generating and catching member by the action of the electric field, and which catches the volatile chemical substances. This makes it possible to realize a volatile chemical substance catching device and an electronic apparatus that hardly suffer from aged deterioration in performance and can catch volatile chemical compounds such as VOCs and odors over a long period of time.

8 Claims, 6 Drawing Sheets

VOLATILE CHEMICAL SUBSTANCE CATCHING DEVICE AND ELECTRONIC APPARATUS

This Nonprovisional application claims priority under 35 U.S.C. §119(a) on Patent Application No. 2008-136920 filed in Japan on May 26, 2008, the entire contents of which are hereby incorporated by reference.

TECHNICAL FIELD

The present technology relates to a volatile chemical substance catching device and an electronic apparatus (such as a personal computer, a copier, or a printer) for catching volatile chemical substances (chemical emissions) such as odors and VOCs (volatile organic compounds).

BACKGROUND ART

In recent years, VOCs have drawn attention as substances that cause allergy symptoms or sick building syndrome, which develops into health hazards such as headaches and dizziness. The VOCs are known to be emitted from electronic apparatuses such as personal computers, copiers, and printers. Furthermore, among these electronic apparatuses, image forming apparatuses such as copiers and printers not only emit VOCs, but also have a problem with peculiar odors that are generated from heated sheets of paper or heated toner.

In order to deal with such a problem of generation of volatile chemical substances such as VOCs and odors from image forming apparatus, image forming apparatuses such as copiers and printers are provided with VOC honeycomb filters (which use activated carbon or catalysts) or negative ion generating devices for catching volatile chemical substances such as VOCs and odors.

For example, Japanese Patent Application Publication, Tokukai, No. 2007-47496 A (Publication Date: Feb. 22, 2007) proposes a technique for emitting negative ions by applying a high negative voltage to a needle electrode located downstream of fixing means in the direction that a sheet is conveyed in an image forming apparatus, and for reducing a positively charged odorous component that is generated when a fixing section is heated.

However, the conventional technique has the following problems.

First, in the case of use of a filter to catch volatile chemical substances such as VOCs and odors, there naturally occurs aged deterioration in performance. In order to overcome such aged deterioration in performance, the honeycomb structure is made finer to increase in area of contact with air currents. However, there is a trade-off, i.e., a hindrance to passage of heat out of the image forming apparatus, which causes a rise in temperature in the image forming apparatus, and such a rise in temperature consequently brings about a secondary negative effect.

Second, in the case of use of a needle electrode as a negative ion generating device, foreign matter (e.g., Si-based material) adheres to the needlepoint to cause discharging deficiency, thus causing a decrease in emissions of negative ions. Further, since the needlepoint is blunted over time by application of a high voltage, deterioration in performance cannot be avoided.

SUMMARY OF TECHNOLOGY

The present technology has been made in view of the foregoing problems. It is an object of the present technology to provide a volatile chemical substance catching device and an electronic apparatus that hardly suffer from aged deterioration in performance and can catch volatile chemical compounds such as VOCs and odors over a long period of time.

In order to attain the foregoing object, an electronic apparatus of the present technology is an electronic apparatus inside of whose housing volatile chemical substances are generated, the electronic apparatus including: a volatile chemical substance catching section, provided inside of the housing, which generates an electric field in an atmosphere, which attracts the volatile chemical substances contained in the atmosphere thereto by the action of the electric field, and which catches the volatile chemical substances.

According to this, the volatile chemical substances generated inside of the housing are caught by the volatile chemical substance catching section provided inside of the housing. The volatile chemical substance catching section generates an electric field in an atmosphere, attracts the volatile chemical substances contained in the atmosphere thereto by the action of the electric field, and catches the volatile chemical substances. The volatile chemical substances thus caught are merely attracted to an electric-field generating surface, and as such, can be easily removed with use of cloth or the like. Thus, repeated use becomes possible.

This enables an arrangement that hardly suffers from aged deterioration in performance and can catch volatile chemical compounds such as VOCs and odors over a long period of time, in comparison with the conventional arrangement.

In order to attain the foregoing object, a volatile chemical substance catching device includes: an electric-field generating and catching member for generating an electric field in an atmosphere, for attracting volatile chemical substances contained in the atmosphere to a surface thereof by the action of the electric field, and for catching the volatile chemical substances; and a connector via which a voltage is supplied to the electric-field generating and catching member from a power supply device that generates a high voltage.

Although already described as an electronic apparatus, this enables an arrangement that hardly suffers from aged deterioration in performance and can catch volatile chemical compounds such as VOCs and odors over a long period of time, in comparison with the conventional arrangement.

For a fuller understanding of the nature and advantages of the technology, reference should be made to the ensuing detailed description taken in conjunction with the accompanying drawings.

BRIEF DESCRIPTION OF DRAWINGS

FIG. 1(*b*) is a transverse sectional view of the area above the fixing unit.

FIG. 3(*b*) is a transverse sectional view of the area above the fixing unit.

FIG. 4(*b*) is a transverse sectional view of the area above the fixing unit.

FIG. 5(*b*) is a transverse sectional view of the area above the fixing unit.

DESCRIPTION OF EMBODIMENTS

Embodiment 1

Embodiment 1 of the present technology is described below with reference to the attached drawings. It should be noted that the present embodiment explains a case where an image forming apparatus of the present technology is applied to a color multifunction apparatus 100.

Figure 2:
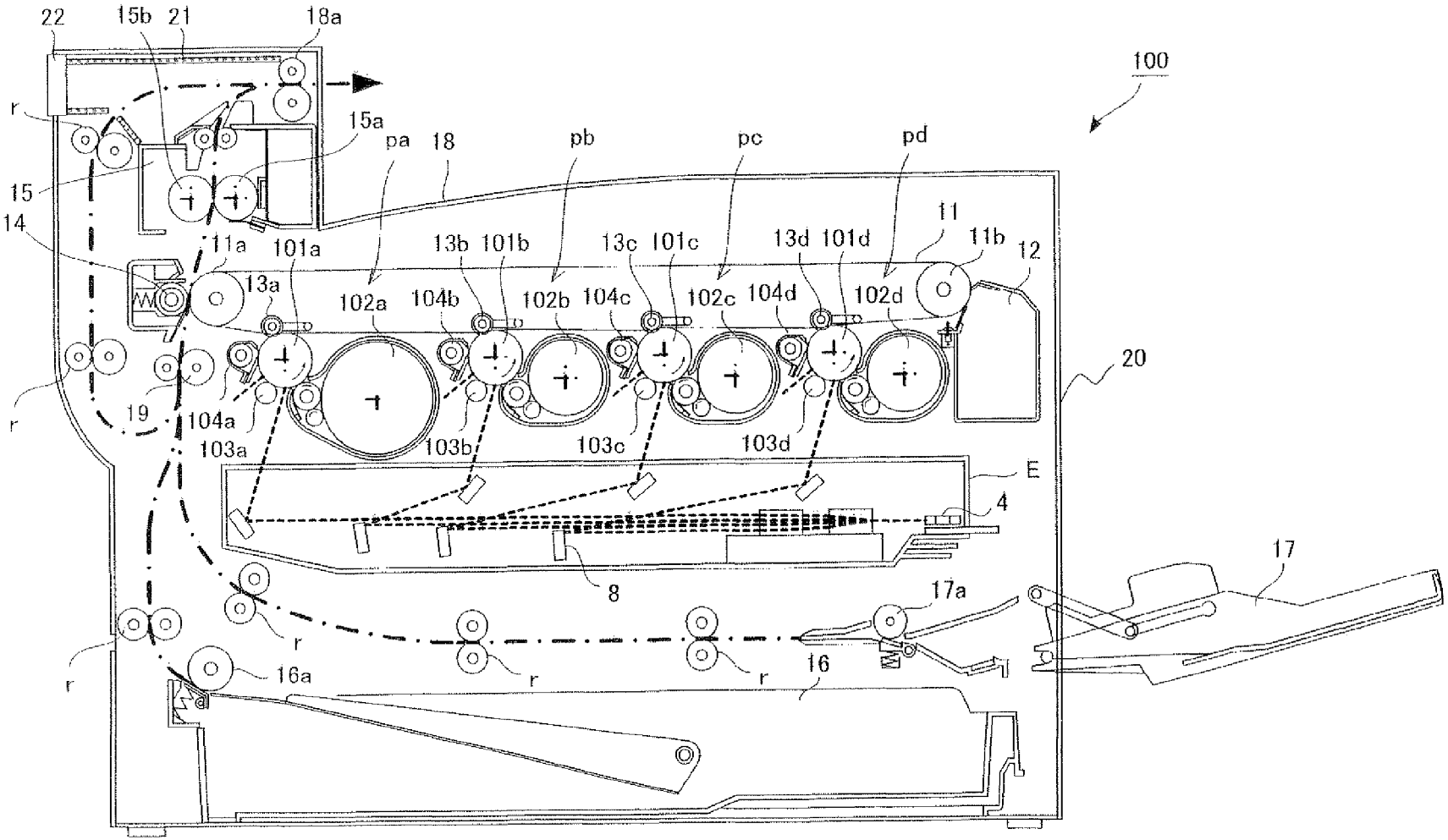
FIG. 2, showing the embodiment of the present technology, is a longitudinal sectional view schematically illustrating an arrangement of a color multifunction printer.

FIG. 2, showing Embodiment 1, is a longitudinal sectional view schematically illustrating an arrangement of the color multifunction printer 100.

The color multifunction printer 100 is an electrophotographic image forming apparatus that forms a multicolor or monochrome image on a sheet (recording material, recording sheet of paper) in accordance with print job data inputted from a personal computer or the like (not illustrated).

As illustrated in FIG. 2, the color multifunction printer 100 has an image forming section that forms an image on a sheet. The image forming section includes: an optical unit E; four visible-image forming units pa, pb, pc, and pd; an intermediate transfer belt 11; a second transfer unit 14; a fixing unit 15; an internal paper feeding unit 16; a housing 25; a manual paper feeding unit 17; and a paper output tray 18. The housing 25 houses the optical unit E, the visible-image forming units pa to pd, the intermediate transfer belt 11, the second transfer unit 14, the fixing unit 15, and the internal paper feeding unit 16. The manual paper feeding unit 17 and the paper output tray 18 are provided outside of the housing 25.

The visible-image forming units pa to pd form black (K), yellow (Y), magenta (M), and cyan (C) toner images, respectively. The visible-image forming unit pa is structured such that a developing unit 102*a*, a charging unit 103*a*, and a cleaning unit 104*a* are disposed around a photoreceptor drum 101*a* serving as a toner image carrier.

Figure 1A:
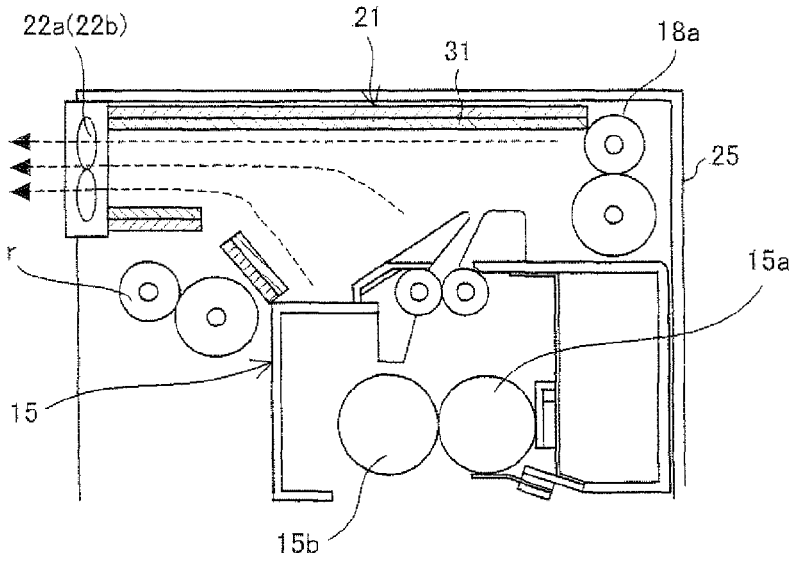
FIG. 1(*a*), showing an embodiment of the present technology, is a longitudinal sectional view of a fixing unit and the vicinity of an area above the fixing unit.
Figure 1B:
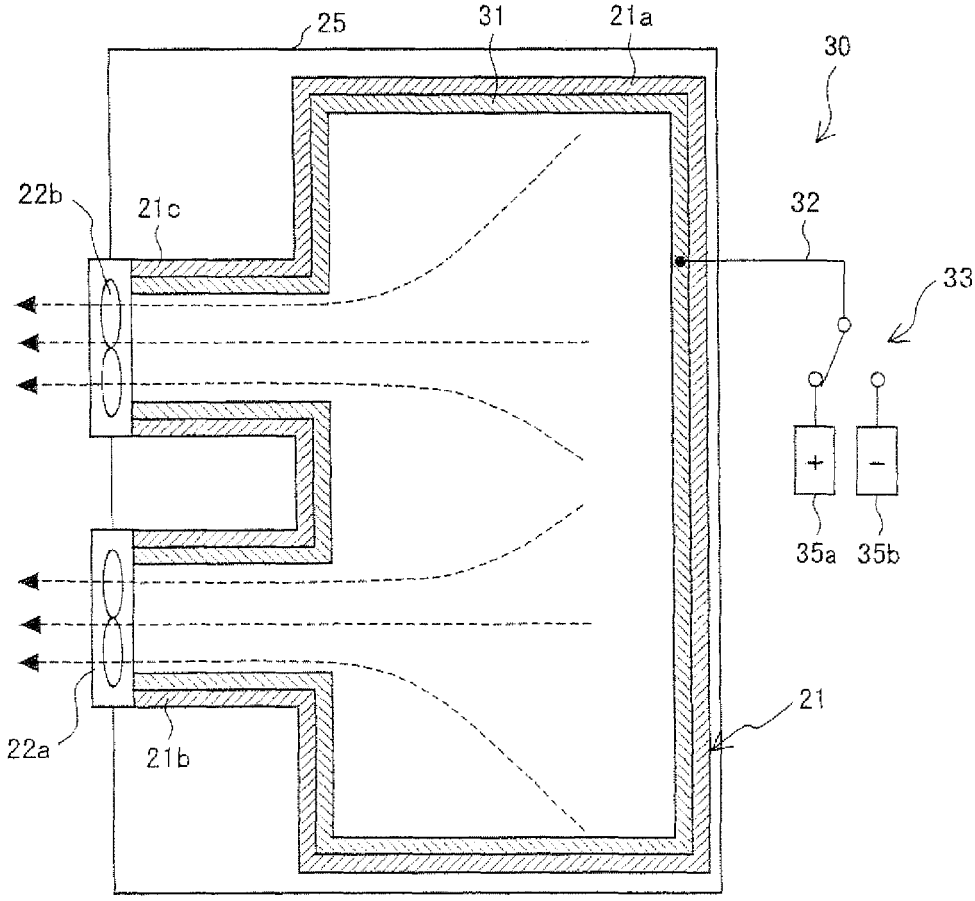

The charging unit 103*a* charges a surface of the photoreceptor drum 101*a* uniformly at a predetermined potential. In the present embodiment, the charging unit 103*a* is of a charging roller type; therefore, the charging unit 103*a* can charge the surface of the photoreceptor drum 101*a* uniformly at a predetermined potential, while generating as few ozone as possible. Instead of being of a contact roller type as illustrated in FIG. 1, the charging unit 103*a* may be of a contact brush type or of a noncontact charger type.

The optical unit E includes a laser irradiation section 4 and a reflection mirror 8. In accordance with print job data inputted, the optical unit E exposes the photoreceptor drums 101*a*, 101*b*, 101*c*, and 101*d* to light from the laser irradiation section 4, and forms electrostatic latent images on the photoreceptor drums, respectively. Instead of being arranged as described above, an exposure unit 1 may use a writing head in which light-emitting elements have been arranged in an array shape, e.g., an EL or LED writing head.

The developing unit 102*a* makes the electrostatic latent image formed on the photoreceptor drum 101*a* visible with toner. The developing unit 102*a* has black toner; the developing units 102*b*, 102*c*, and 102*d* have yellow toner, magenta toner, and cyan toner, respectively. Disposed above the photoreceptor drum 101*a* via the intermediate transfer belt 11 is a first transfer unit 13*a* that transfers, onto the intermediate transfer belt 11, the toner image formed on the surface of the photoreceptor drum 101*a*. The cleaning unit 104*a* removes and collects toner remaining on the surface of the photoreceptor drum 101*a* after the transferring step.

The other three visible-image forming units pb, pc, and pd are structured in the same manner as the aforementioned visible-image forming unit pa.

The intermediate transfer belt 11 is pulled by two tension rollers 11*a* and 11*b* so as to be tight. Disposed on a side of the intermediate transfer belt 11 that faces the tension roller 11*b* is a waste toner box 12. Further, the second transfer unit 14 is disposed on a side of the intermediate transfer belt 11 that faces the tension roller 11*a*, so as to make contact with the intermediate transfer belt 11.

The fixing unit 15 is constituted by a fixing roller 15*a* and a pressure roller 15*b*. The fixing roller 15*a* and the pressure roller 15*b* are pressed against each other at a predetermined pressure by pressure means (not illustrated). It should be noted that the fixing unit 15 is located downstream of the paper conveying direction with respect to the second transfer unit 14.

In such a color multifunction printer 100, an image formation process is performed as follows: First, the charging unit 103*a* uniformly charges the surface of the photoreceptor drum 101*a*. Then, the optical unit E exposes the charged area of the surface of the photoreceptor drum 101*a* to a laser in accordance with image data. Thus formed is an electrostatic latent image. Then, the electrostatic latent image on the photoreceptor drum 101*a* is developed with toner by the developing unit 102*a*. Thus obtained is a toner image. The toner image is transferred onto the intermediate transfer belt 11 by the first transfer unit 13*a*, to which a bias voltage opposite in polarity to the toner has been applied. The other three visible-image forming units pb, pc, and pd operate in the same manner. Thus, toner images of the respective colors are sequentially transferred onto the intermediate transfer belt 11 so as to be superimposed onto one another.

The toner image on the intermediate transfer belt 11 is conveyed to the second transfer unit 14. The second transfer unit 14, to which a bias voltage opposite in polarity to the toner, transfers the toner image onto a recording sheet of paper fed from the internal paper feeding unit 16 via a paper feeding roller 16*a* or from the manual paper feeding unit 17 via a paper feeding roller 17*a*. Then, the toner image on the recording sheet of paper is conveyed to the fixing unit 15, and the fixing unit 15 fuses the toner image onto the recording sheet of paper by sufficiently heating the toner image. The recording sheet of paper, on which the toner image has been fused, is discharged onto the paper output tray 18 via a paper output roller 18*a*.

Further, in such a color multifunction printer 100, the four visible-image forming units pa, pb, pc, and pd generate ozone gas components, and the fixing unit 15 generates volatile component gas and heat.

For this reason, although not illustrated in FIG. 2, the housing 25 has an exhaust duct provided therein through which generated gas and generated heat pass out of the color multifunction printer 100. Further, the exhaust duct has an exhaust fan installed in the vicinity of a vent thereof.

FIG. 1(*a*) is a longitudinal sectional view of the fixing unit 15 and the vicinity of an area above the fixing unit 15, and FIG. 1(*b*) is a transverse sectional view of the area above the fixing unit 15. It should be noted that FIG. 1(*b*) omits an illustration of the fixing unit 15 and the like and illustrates only members involved in exhaust ventilation.

Provided in the area above the fixing unit 15, as illustrated in FIG. 1(*a*), is an exhaust duct 21 through which volatile component gas and excess heat generated in the fixing unit 15 are discharged. As illustrated in FIG. 1(*b*), the exhaust duct 21 is provided so as to cover a space above the fixing unit 15, and includes a main body 21*a* and two conduits 21*b* and 21*c*. Each of the conduits 21*b* and 21*c* extends from the main body 21*a* out of the color multifunction printer 100. The exhaust duct 21 is suitably made of ABS resin, whose shape can be retained and which exhibits appropriate levels of nonconducting properties and heat resistance.

Provided in the vicinity of a vent of the conduit 21*b* is an exhaust fan 22*a*. Provided in the vicinity of a vent of the conduit 21*c* is an exhaust fan 22*b*.

Because of such an arrangement, air containing volatile component gas and excess heat that have been generated in the fixing unit 15 is accumulated efficiently in the main body 21*a* covering the area above the fixing unit 15 and discharged out of the color multifunction printer 100 through the conduits 21*b* and 21*c* by the action of air currents formed by the exhaust fans 22.

Moreover, the color multifunction printer 100 of the present embodiment includes a volatile chemical substance catching device (volatile chemical substance catching section) 30, provided inside of the housing 25 or, in particular, inside of the exhaust duct 21, which generates an electric field in an atmosphere, which attracts volatile chemical substances contained in the atmosphere to its surface by the action of the electric field, and which catches the volatile chemical substances.

The volatile chemical substance catching device 30 includes: an electric-field generating and catching member 31, disposed inside of the exhaust duct 21, which generates an electric field from its surface in response to a voltage applied thereto, which attracts volatile chemical substances contained in the atmosphere to its surface by the action of the electric field, and which catches the volatile chemical substances; and a connector 32 via which a high voltage is supplied to the electric-field generating and catching member 31 from either a negative or positive high-voltage power supply 35*a* or 35*b* provided in the color multifunction printer 100.

The electric-field generating and catching member 31 is connected via the connector 32 to either the negative high-voltage power supply 35*a*, which generates a negative high voltage, or the positive high-voltage power supply 35*b*, which generates a positive high voltage. The electric-field generating and catching member 31 generates an electric field in an adjacent space in response to a high voltage supplied thereto, attracts volatile chemical substances contained in the atmosphere to its surface by the action of the electric field, and catches the volatile chemical substances.

In the present embodiment, the electric-field generating and catching member 31 is a thin-plate member identical in shape to an inner wall of the exhaust duct 21. The electric-field generating and catching member 31 is disposed along the inner wall of the exhaust duct 21 substantially entirely so as to cover the inner wall, thereby securing a wide catching surface. It should be noted that the electric-field generating and catching member 31 does not necessarily need to be provided entirely on the inner wall of the exhaust duct 21 and the inner wall may have a portion in which the electric-field generating and catching member 31 is not provided.

Such an electric-field generating and catching member 31 only needs to exhibit conductivity and durability, and as such, it can be made mainly of metal such as iron, SUS, gold, silver, copper, or tungsten. Among them, SUS is preferred because it is rustproof, inexpensive, easy to process, and resistant to change in shape.

Other than those above, organic conducting materials can be used. However, an organic conducting material comparatively high in resistance changes in shape due to heat caused by electrical conduction. This makes it impossible to keep a fixed distance and makes it difficult to form a uniform electric field. Therefore, it is necessary to choose an organic conducting material that is as low as possible in resistance.

Provided between the connector 32 and the high-voltage power supplies 35*a* and 35*b* is a switch 33 that a user uses to connect either the negative or positive high-voltage power supply 35*a* or 35*b* to the electric-field generating and catching member 31.

In general, volatile chemical substances are often positively charged. For this reason, the positively-charged volatile chemical substances can be caught by connecting the electric-field generating and catching member 31 to the negative high-voltage power supply 35*a* so that the surface of the electric-field generating and catching member 31 becomes negative in potential.

Further, in cases where the volatile chemical substances to be caught are negatively charged or in cases where more of the volatile chemical substances are charged negatively than positively, it is only necessary to connect the electric-field generating and catching member 31 to the positive high-voltage power supply 35*b* so that the surface of the electric-field generating and catching member 31 becomes positive in potential.

The present embodiment is arranged to make it possible to connect the electric-field generating and catching member 31 selectively to both the negative and positive high-voltage power supplies 35*a* and 35*b*. However, in cases where it has been determined whether the volatile chemical substances to be caught are negatively or positively charged, it is only necessary to arrange to include either the negative or positive high-voltage power supply 35*a* or 35*b*.

A negative or positive high voltage to be applied to the electric-field generating and catching member 31 is a voltage that can form an electric field capable of attracting the charged volatile chemical substances to the surface of the electric-field generating and catching member 31 and catching the charged volatile chemical substances.

A high voltage is applied to the electric-field generating and catching member 31 at the time of operation of the exhaust fans 22*a* and 22*b* (during printing, at the time of warming up before printing, and the time of cooling down after printing). Operation of the volatile chemical substance catching device 30 is not limited to the time of operation of the exhaust fans 22*a* and 22*b*. It is possible to cause the volatile chemical substance catching device 30 to operate for a predetermined period of time after stoppage of the exhaust fans 22*a* and 22*b*. In addition, in cases where the exhaust duct 21 has a VOC sensor provided therein, it is possible to cause the volatile chemical substance catching device 30 to operate until the concentration of VOCs reaches a predetermined concentration. It is not essential here to cause the volatile chemical substance catching device 30 to operate in conjunction with the exhaust fans 22*a* and 22*b*. It is possible to cause the volatile chemical substance catching device 30 to operate solely with the exhaust fans 22*a* and 22*b* stopped.

The volatile chemical substance catching device 30 thus arranged allows the electric-field generating and catching member 31 to be large in area. Therefore, unlike in a negative ion generating device using a needle electrode, no foreign matter adheres to the needlepoint to cause discharging deficiency, and performance can be maintained over a long period of time.

Further, unlike in a volatile chemical substance catching filter, passage of heat out of the color multifunction printer 100 is not hindered even when the electric-field generating and catching member 31 is allowed to be large in area of contact with air currents.

Moreover, in cases where long-term use causes adhesion of volatile chemical substances to the surface of the electric-field generating and catching member 31 and thus deterioration in performance, the catching surface of the electric-field generating and catching member 31 can be easily refreshed by cleaning the surface with fiber such as cloth with no voltage applied to the electric-field generating and catching member 31. For safety reasons, it is preferable that such a cleaning operation be performed with the color multifunction printer 100 powered off.

Further, in the present embodiment, the electric-field generating and catching member 31 of the volatile chemical substance catching device 30 is provided in the exhaust duct 21. Therefore, passage of volatile chemical substances out of the color multifunction printer 100 can be effectively inhibited by efficiently removing the volatile chemical substances from air passing out of the color multifunction printer 100 through the exhaust duct 21.

Further, in the present embodiment, the electric-field generating and catching member 31 is located upstream of the direction of air currents by the exhaust fans 22*a* and 22*b* with respect to the exhaust fans 22*a* and 22*b*. Therefore, gas containing volatile chemical substances does not flow to the exhaust fans 22*a* and 22*b*. This makes it possible to improve an opportunity for the electric-field generating and catching member 31 to catch the volatile chemical substances.

Incidentally, in the above arrangement, there is no counter electrode provided near the electric-field generating and catching member 31. For this reason, a ground that is included in the color multifunction printer 100 as seen from the electric-field generating and catching member 31 serves as a counter electrode at infinity.

If there exists a counter electrode near the electric-field generating and catching member 31, an electric field between the electric-field generating and catching member 31 and the counter electrode is enhanced. This results in an improvement in catching ability in that space. However, at the same time, the action of an electric field is weakened in a space other than the space between the electric-field generating and catching member 31 and the counter electrode. This results in deterioration in catching ability. An arrangement provided with no counter electrode makes it possible to secure uniform catching ability entirely in a space that the electric-field generating and catching member 31 faces.

Further, in cases where a counter electrode is provided, an electric field between the electric-field generating and catching member 31 and the counter electrode is strengthened. This may cause electrical discharge or the like and thus generation of ozone gas. However, the absence of a counter electrode makes it possible to surely eliminate the generation of ozone gas due to electrical discharge.

Although the present embodiment is arranged such that the electric-field generating and catching member 31 is provided substantially entirely on the inner wall of the exhaust duct 21, the exhaust duct can be made of the above material that can be used for the electric-field generating and catching member 31, and the functioning of the exhaust duct and the electric-field generating and catching member 31 can be integrated.

However, it is necessary to take measures to prevent a high-voltage leak from occurring between the exhaust duct and the main body and process units of the color multifunction printer 100.

Embodiment 2

Embodiment 2 of the present technology is described with reference to the attached drawings. A color multifunction printer of the present embodiment differs from the aforementioned color multifunction printer 100 of Embodiment 1 in that the color multifunction printer of the present embodiment has auxiliary electric-field generating and catching members 34*a* and 34*b* provided in the exhaust duct 21. The auxiliary electric-field generating and catching members 34*a* and 34*b* serve as auxiliary members for the electric-field generating and catching member 31 of the volatile chemical substance catching device 30.

Except for the provision of the auxiliary electric-field generating and catching members 34*a* and 34*b*, the multifunction printer of the present embodiment is identical to the aforementioned color multifunction printer 100 of Embodiment 1. Therefore, components identical to those of Embodiment 1 are not described here.

Figure 3A:
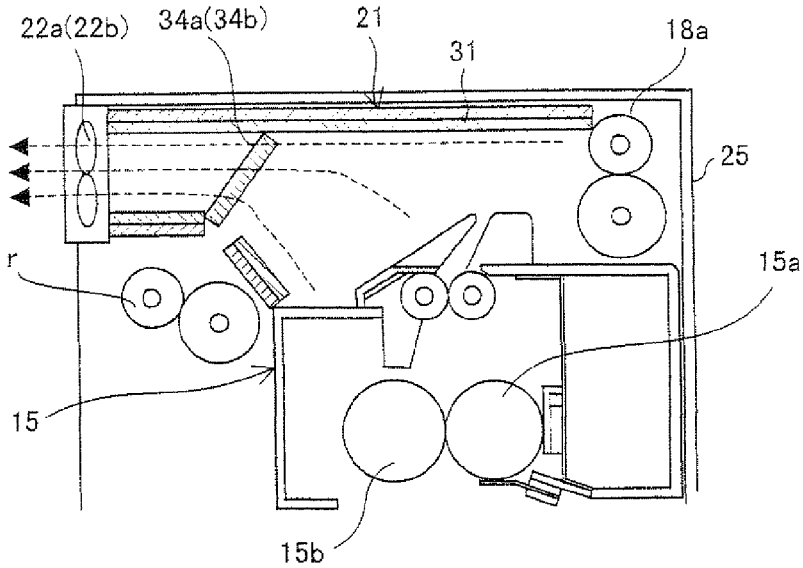
FIG. 3(*a*), showing another embodiment of the present technology, is a longitudinal sectional view of a fixing unit and the vicinity of an area above the fixing unit.
Figure 3B:
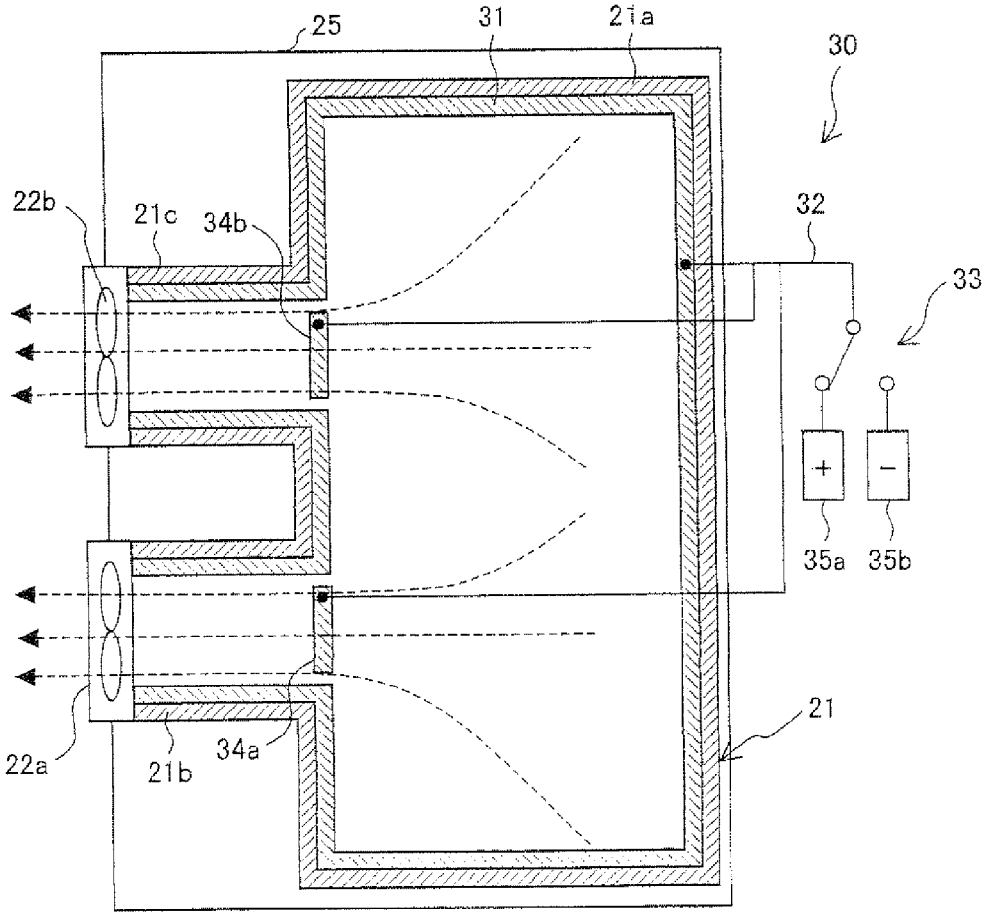

FIG. 3(*a*) is a longitudinal sectional view of the fixing unit 15 of the present embodiment and the vicinity of an area above the fixing unit 15, and FIG. 3(*b*) is a transverse sectional view of the area above the fixing unit 15 of the present embodiment. It should be noted that FIG. 3(*b*) omits an illustration of the fixing unit 15 and the like and illustrates only members involved in exhaust ventilation.

While the electric-field generating and catching member 31, formed along the inner wall of the exhaust duct 21, serves as a main electric-field generating and catching member (first electric-field generating and catching member), the auxiliary electric-field generating and catching members 34*a* and 34*b* (second electric-field generating and catching members) are disposed aslant in inlet zones of the conduits 21*b* and 21*c* where the air currents inside of the exhaust duct 21 are aggregated, respectively, so that the direction of main air currents is normal to the surfaces of the auxiliary electric-field generating and catching members 34*a* and 34*b* where electric fields are formed.

The auxiliary electric-field generating and catching members 34*a* and 34*b* are disposed at distances from parts of the electric-field generating and catching member 31 that surround the auxiliary electric-field generating and catching members 34*a* and 34*b* (i.e., from the inner wall of the exhaust duct 21), respectively. As such, the auxiliary electric-field generating and catching members 34*a* and 34*b* temporarily block the main air currents by making contact with the main air currents, but do not further block the flow of air currents going to the backs of the auxiliary electric-field generating and catching members 34*a* and 34*b*.

Moreover, the auxiliary electric-field generating and catching members 34*a* and 34*b* are supplied with a high voltage from either the negative or positive high-voltage power supply 35*a* or 35*b* via the connector 32 described above. The high voltage is identical to the high voltage applied to the electric-field generating and catching member 31.

Such an arrangement makes it possible to send out air without delay through sufficient space secured between the auxiliary electric-field generating and catching members 34*a* and 34*b* and the electric-field generating and catching member 31, and at the same time, to effectively catch volatile chemical substances with the auxiliary electric-field generating and catching members 34*a* and 34*b* by preventing the volatile chemical substances from flowing into the exhaust fans 22.

Moreover, in this case, in flowing around the auxiliary electric-field generating and catching members 34*a* and 34*b*, the air currents blocked by the auxiliary electric-field generating and catching members 34*a* and 34*b* pass through areas near the auxiliary electric-field generating and catching members 34*a* and 34*b* where there are strong electric fields. Therefore, during the passage of the air currents, the volatile chemical substances can be caught more effectively by the electric-field generating and catching member 31.

Embodiment 3

Embodiment 3 of the present technology is described below with reference to the attached drawings. A color multifunction printer of the present embodiment differs from the aforementioned color multifunction printer 100 of Embodiment 1 in that the color multifunction printer of the present embodiment has VOC gas treating active carbon honeycomb filters 36*a* and 36*b* provided in the exhaust duct 21.

Except for the provision of the VOC gas treating active carbon honeycomb filters 36*a* and 36*b*, the multifunction printer of the present embodiment is identical to the aforementioned color multifunction printer 100 of Embodiment 1. Therefore, components identical to those of Embodiment 1 are not described here.

Figure 4A:
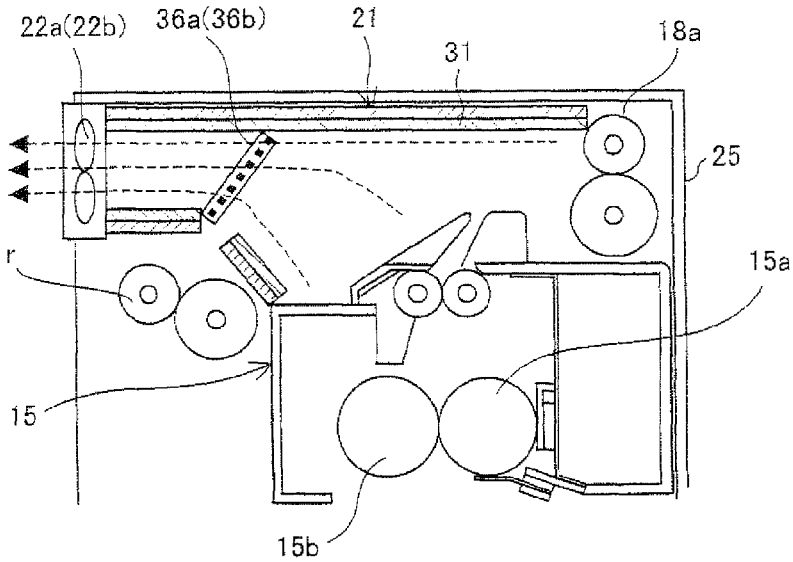
FIG. 4(*a*), showing another embodiment of the present technology, is a longitudinal sectional view of a fixing unit and the vicinity of an area above the fixing unit.
Figure 4B:
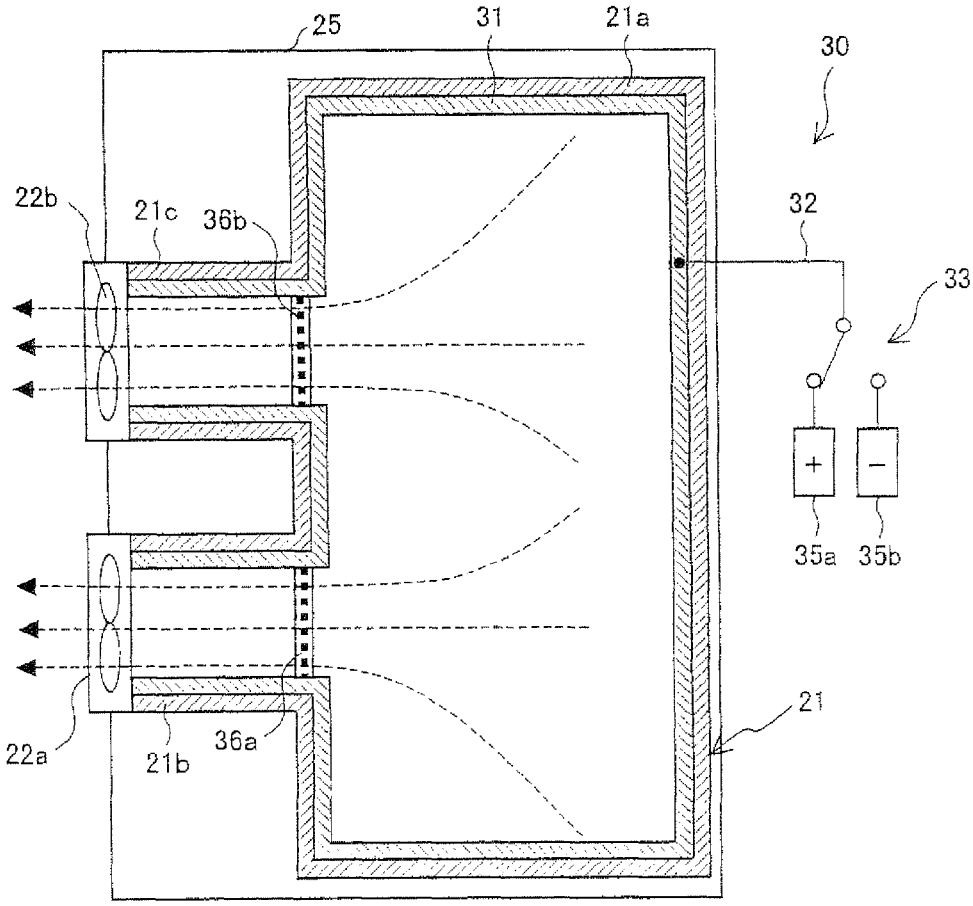

FIG. 4(*a*) is a longitudinal sectional view of the fixing unit 15 of the present embodiment and the vicinity of an area above the fixing unit 15, and FIG. 4(*b*) is a transverse sectional view of the area above the fixing unit 15 of the present embodiment. It should be noted that FIG. 4(*b*) omits an illustration of the fixing unit 15 and the like and illustrates only members involved in exhaust ventilation.

The VOC gas treating active carbon honeycomb filters 36*a* and 36*b* are disposed inside of the exhaust duct 21 or, in particular, in inlet zones of the conduits 21*b* and 21*c* where the air currents inside of the exhaust duct 21 are aggregated, respectively, without forming spaces from parts of the electric-field generating and catching member 31 that surround the VOC gas treating active carbon honeycomb filters 36*a* and 36*b* (i.e., from the inner wall of the exhaust duct 21).

This allows all the air currents that flow into the conduits 21*b* and 21*c* to pass through the VOC gas treating active carbon honeycomb filters 36*a* and 36*b*, whereby volatile component gas that has not been completely caught by the electric-field generating and catching member 31, formed along the main body 21*a* of the exhaust duct 21, can be adsorbed.

In the arrangement of FIGS. 4(*a*) and 4(*b*), the VOC gas treating active carbon honeycomb filters 36*a* and 36*b* are located upstream of the air currents with respect to the exhaust fans 22*a* and 22*b*, respectively. However, the VOC gas treating active carbon honeycomb filters 36*a* and 36*b* can be located downstream of the exhaust fans 22*a* and 22*b*, respectively.

Embodiment 4

Embodiment 4 of the present technology is described below with reference to the attached drawings. A color multifunction printer of the present embodiment differs from the aforementioned color multifunction printer 100 of Embodiment 1 in that the color multifunction printer of the present embodiment has both the auxiliary electric-field generating and catching members 34*a* and 34*b* of Embodiment 2 and the VOC gas treating active carbon honeycomb filters 36*a* and 36*b* of Embodiment 3 provided in the exhaust duct 21.

Except for the provision of the auxiliary electric-field generating and catching members 34*a* and 34*b* and the VOC gas treating active carbon honeycomb filters 36*a* and 36*b*, the multifunction printer of the present embodiment is identical to the aforementioned color multifunction printer 100 of Embodiment 1. Further, the auxiliary electric-field generating and catching members 34*a* and 34*b* are identical in structure to those of Embodiment 2, and the VOC gas treating active carbon honeycomb filters 36*a* and 36*b* are identical in structure to those of Embodiment 3. Therefore, components identical to those of Embodiments 1 to 3 are not described here.

Figure 5A:
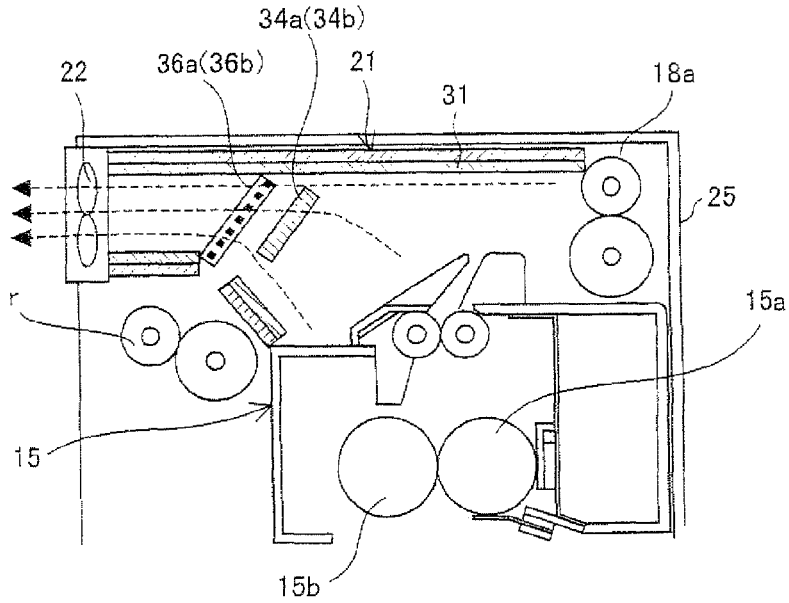
FIG. 5(*a*), showing another embodiment of the present technology) is a longitudinal sectional view of a fixing unit and the vicinity of an area above the fixing unit.
Figure 5B:
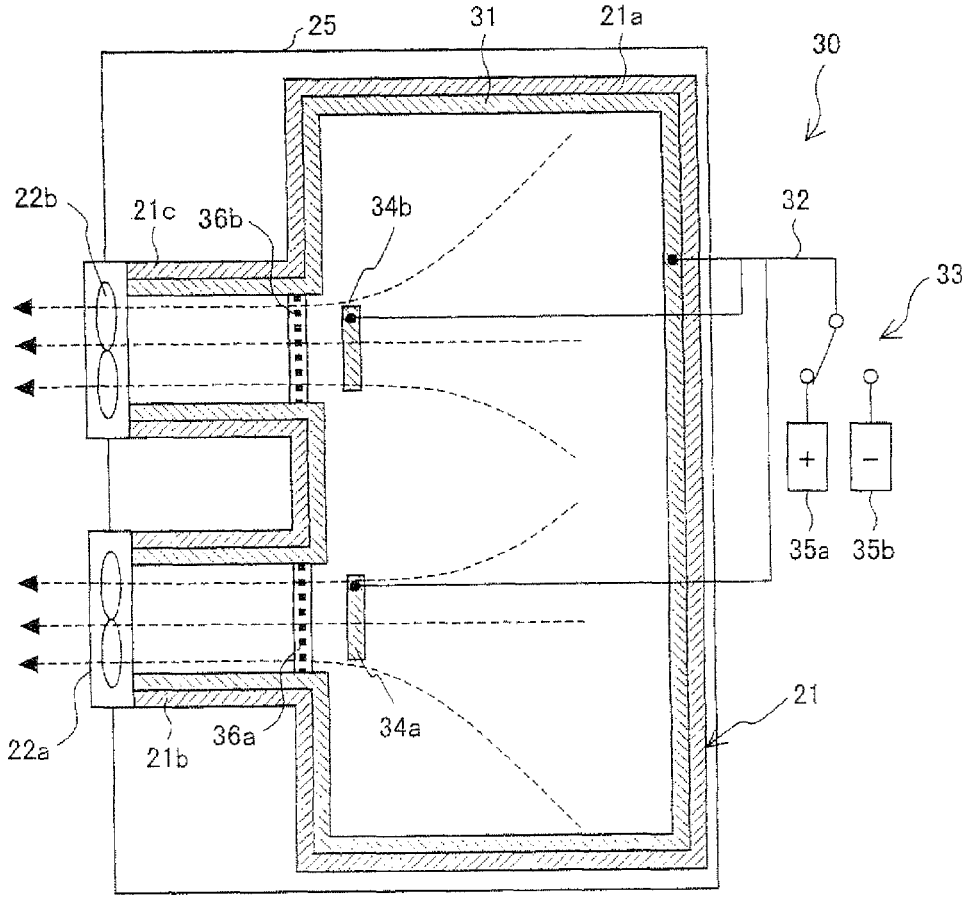

FIG. 5(*a*) is a longitudinal sectional view of the fixing unit 15 of the present embodiment and the vicinity of an area above the fixing unit 15, and FIG. 5(*b*) is a transverse sectional view of the area above the fixing unit 15 of the present embodiment. It should be noted that FIG. 5(*b*) omits an illustration of the fixing unit 15 and the like and illustrates only members involved in exhaust ventilation.

The VOC gas treating active carbon honeycomb filters 36*a* and 36*b* are disposed inside of the exhaust duct 21 or, in particular, in inlet zones of the conduits 21*b* and 21*c* where the air currents inside of the exhaust duct 21 are aggregated, respectively, without keeping any distances from parts of the electric-field generating and catching member 31 that surround the VOC gas treating active carbon honeycomb filters 36*a* and 36*b* (i.e., from the inner wall of the exhaust duct 21). The auxiliary electric-field generating and catching members 34*a* and 34*b* are located upstream of the air currents with respect to the VOC gas treating active carbon honeycomb filters 36*a* and 36*b*, respectively.

The auxiliary electric-field generating and catching members 34*a* and 34*b* are appropriately spaced from the VOC gas treating active carbon honeycomb filters 36*a* and 36*b*, respectively, so that the air currents passing through the VOC gas treating active carbon honeycomb filters 36*a* and 36*b* are not blocked.

In the arrangement of FIGS. 5(*a*) and 5(*b*), the VOC gas treating active carbon honeycomb filters 36*a* and 36*b* are located upstream of the air currents with respect to the exhaust fans 22*a* and 22*b*, respectively. However, the VOC gas treating active carbon honeycomb filters 36*a* and 36*b* can be located downstream of the exhaust fans 22*a* and 22*b*, respectively.

Alternatively, it is possible to locate the VOC gas treating active carbon honeycomb filters 36*a* and 36*b* upstream of the air currents with respect to the auxiliary electric-field generating and catching members 34*a* and 34*b*. However, unlike the auxiliary electric-field generating and catching members 34*a* and 34*b*, the VOC gas treating active carbon honeycomb filters 36*a* and 36*b* cannot be cleaned with fiber such as cloth. Therefore, it is preferable that the VOC gas treating active carbon honeycomb filters 36*a* and 36*b* be located downstream of the auxiliary electric-field generating and catching members 34*a* and 34*b*.

EXAMPLES (1) A color multifunction printer of Example 1 arranged as described above in Embodiment 1 was prepared. The electric-field generating and catching member 31 was formed entirely on the inner wall of the exhaust duct 21 with use of an SUS 304 plate having a thickness of 5 mm. In the experiment, a Trek's MODEL 610C was used as voltage applying means having the function of the negative high-voltage power supply 35*a*. Moreover, a voltage of −10 kV was applied to the electric-field generating and catching member 31 at the time of operation of the exhaust fans 22*a* and 22*b* (during printing, at the time of warming up before printing, and the time of cooling down after printing), whereby a negative potential was formed on the surface of the electric-field generating and catching member 31.

(2) A color multifunction printer of Example 2 arranged as described above in Embodiment 2 was prepared. The electric-field generating and catching member 31 was formed entirely on the inner wall of the exhaust duct 21 with use of an SUS 304 plate having a thickness of 5 mm. Further, the auxiliary electric-field generating and catching members 34*a* and 34*b* were each formed with use of an SUS 304 plate having a thickness of 5 mm with the dimensions 50 mm×20 mm. In the experiment, a Trek's MODEL 610C was used as voltage applying means having the function of the negative high-voltage power supply 35*a*. Moreover, a voltage of −10 kV was applied to the electric-field generating and catching member 31 and the auxiliary electric-field generating and catching members 34*a* and 34*b* at the time of operation of the exhaust fans 22*a* and 22*b* (during printing, at the time of warming up before printing, and the time of cooling down after printing), whereby a negative potential was formed on the surface of the electric-field generating and catching member 31 and the surfaces of the auxiliary electric-field generating and catching members 34*a* and 34*b*.

(3) A color multifunction printer of Example 3 arranged as described above in Embodiment 3 was prepared. The electric-field generating and catching member 31 was formed entirely on the inner wall of the exhaust duct 21 with use of an SUS 304 plate having a thickness of 5 mm. Upstream of the exhaust fans 22*a* and 22*b*, Toyobo's DPB-600s were located as VOC gas treating active carbon honeycomb filters. In the experiment, a Trek's MODEL 610C was used as voltage applying means having the function of the negative high-voltage power supply 35*a*. Moreover, a voltage of −10 kV was applied to the electric-field generating and catching member 31 at the time of operation of the exhaust fans 22*a* and 22*b* (during printing, at the time of warming up before printing, and the time of cooling down after printing), whereby a negative potential was formed on the surface of the electric-field generating and catching member 31.

(4) A color multifunction printer of Example 4 arranged as described above in Embodiment 4 was prepared. The electric-field generating and catching member 31 was formed entirely on the inner wall of the exhaust duct 21 with use of an SUS 304 plate having a thickness of 5 mm. Similarly, the auxiliary electric-field generating and catching members 34*a* and 34*b* were each formed with use of an SUS 304 plate having a thickness of 5 mm with the dimensions 50 mm×20 mm. Upstream of the exhaust fans 22*a* and 22*b*, Toyobo's DPB-600s were located as VOC gas treating active carbon honeycomb filters. In the experiment, a Trek's MODEL 610C was used as voltage applying means having the function of the negative high-voltage power supply 35*a*. Moreover, a voltage of −10 kV was applied to the electric-field generating and catching member 31 and the auxiliary electric-field generating and catching members 34*a* and 34*b* at the time of operation of the exhaust fans 22*a* and 22*b* (during printing, at the time of warming up before printing, and the time of cooling down after printing), whereby a negative potential was formed on the surface of the electric-field generating and catching member 31 and the surfaces of the auxiliary electric-field generating and catching members 34*a* and 34*b*.

Figure 6:
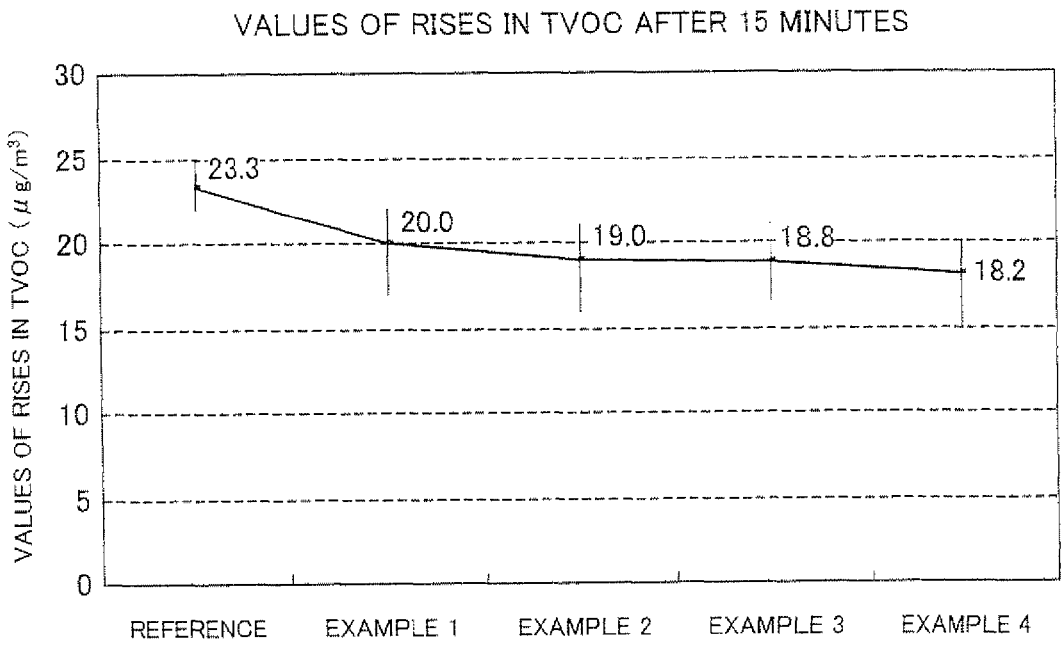
FIG. 6 is an explanatory diagram illustrating an experimental result showing the values of rises in TVOC in examples of the present technology.

Each of the color multifunction printers of Examples (1) to (4) thus arranged was installed in a closed chamber having a capacity of approximately 9 $m^3$. FIG. 6 illustrates a measurement result showing the values of rises in TVOC (total volatile organic compounds) caused in the chamber when duplex black-and-white printing was continuously performed for 15 minutes.

To describe the method for experiment in more detail, the inner wall of the chamber was cleaned with pure water, and the chamber was sufficiently ventilated. TVOC_s was measured in a stand-by state, i.e., in a state where the color multifunction printer has been left powered on for not less than one hour at 23 degrees Celsius and 50% relative humidity, and TVOC_p was measured in a print state, i.e., in a state where duplex black-and-white printing was continuously performed for 15 minutes. TVOC_p—TVOC_s served as the value of a rise in TVOC, i.e., as an evaluation item. A JMS's JHV-1000 was used as a TVOC measuring apparatus.

In FIG. 6, "REFERENCE" indicates TVOC measurement data obtained in cases where there were no measures taken between the fixing unit 15 and the exhaust fans 22. While the average value of rises in TVOC in "REFERENCE" is 23.3 μg/$m^3$, the average value of rises in TVOC in Examples 1 to 4, in which the measures of Embodiments 1 to 4 was taken, respectively, is 19.3 μg/$m^3$, whereby it is confirmed that an effect of reducing TVOC was obtained (average of five measurement values in each example). Further, it was also confirmed that Embodiments 1 to 4 differ in effectiveness from one another due to their individual measures.

Further, it was also confirmed that, in cases where a large quantity of volatile chemical substances adheres to the surfaces of the electric-field generating and catching member 31 and the auxiliary electric-field generating and catching members 34*a* and 34*b* and causes deterioration in performance, the surfaces of the electric-field generating and catching member 31 and the auxiliary electric-field generating and catching members 34*a* and 34*b* can be cleaned by wiping on the surfaces with fiber such as alcohol-containing cloth lightly dabbed at the surfaces and then wiping on the same place lightly with water-containing fiber, whereby the reducing effect is revived.

The former wipes with alcohol are to remove the volatile chemical substances adhering to the surfaces of the electric-field generating and catching member 31 and the auxiliary electric-field generating and catching members 34*a* and 34*b*, and the latter wipes with water are to remove alcohol components by the wipes with alcohol and thereby prevent the residual alcohol components from vaporize to secondarily generate VOCs.

Each of Embodiments 1 to 4 has described an image forming apparatus according to the present technology as an electrophotographic image forming apparatus such as a color multifunction printer or a color laser printer. However, the present technology is not limited to an image forming apparatus and, needless to say, are effective for all electronic apparatuses, such as personal computers, that generate VOCs and odors, as well as monochrome image forming apparatuses such as monochrome laser printers and electrophotographic processes.

As described above, an electronic apparatus of the present technology is an electronic apparatus inside of whose housing volatile chemical substances are generated, the electronic apparatus including: a volatile chemical substance catching section, provided inside of the housing, which generates an electric field in an atmosphere, which attracts the volatile chemical substances contained in the atmosphere thereto by the action of the electric field, and which catches the volatile chemical substances.

According to this, the volatile chemical substances generated inside of the housing are caught by the volatile chemical substance catching section provided inside of the housing. The volatile chemical substance catching section generates an electric field in an atmosphere, attracts the volatile chemical substances contained in the atmosphere thereto by the action of the electric field, and catches the volatile chemical substances. The volatile chemical substances thus caught are merely attracted to an electric-field generating surface, and as such, can be easily removed with use of cloth or the like. Thus, repeated use becomes possible.

This enables an arrangement that hardly suffers from aged deterioration in performance and can catch volatile chemical compounds such as VOCs and odors over a long period of time, in comparison with the conventional arrangement.

The electronic apparatus of the present technology can be arranged, furthermore, such that the volatile chemical substance catching section includes an electric-field generating and catching member for generating an electric field from a surface thereof in response to a voltage applied thereto, for attracting the volatile chemical substances contained in the atmosphere to the surface thereof by the action of the electric field, and for catching the volatile chemical substances, the electric-field generating and catching member being disposed inside of an exhaust duct, provided inside of the housing, through which gas containing the volatile chemical substances and contained inside of the housing passes out of the housing.

According to this, the electric-field generating and catching member, which catches the volatile chemical substance by generating an electric field, is provided inside of the exhaust duct, through which the gas containing the volatile chemical substances passes out of the electronic apparatus; therefore, the volatile chemical substances generated inside of the housing can be efficiently caught.

The electronic apparatus of the present technology can be arranged, furthermore, such that the electric-field generating and catching member can be provided inside of the exhaust duct so as to extend along an inner wall of the exhaust duct.

According to this, the volatile chemical substances can be efficiently caught from air currents flowing out of the exhaust duct; therefore catching efficiency can be enhanced, in comparison with an arrangement in which a volatile chemical substance catching section is disposed partially in an exhaust duct.

The electronic apparatus of the present technology can be arranged, furthermore, such that while the electric-field generating and catching member, disposed along the inner wall of the exhaust duct, is a first electric-field generating and catching member, the volatile chemical substance catching section includes a second electric-field generating and catching member disposed at a distance from the first electric-field generating and catching member, disposed along the inner wall of the exhaust duct, so as to squarely receive main air currents flowing through the exhaust duct.

According to this, air currents containing volatile chemical substances are squarely received by the second electric-field generating and catching member; therefore, the volatile chemical substances can be efficiently caught at that time. This makes it possible to prevent air currents containing volatile chemical substances that have not been completely caught by the first electric-field generating and catching member from passing directly out of the electronic apparatus, and to catch the volatile chemical substances more effectively.

The electronic apparatus of the present technology can be arranged, furthermore, so as to further include an exhaust fan that allows gas inside of the housing to pass out of the housing, wherein the electric-field generating and catching member is located upstream of the direction of air currents with respect to the exhaust fan.

This makes it possible to effectively prevent air currents containing volatile chemical substances from passing out of the electronic apparatus without being subjected to the catching action of the volatile chemical substances by the electric-field generating and catching member.

The electronic apparatus of the present technology can be arranged, furthermore, so as to further include a power source device for generating a negative voltage, wherein the electric-field generating and catching member has a negative potential in response to a negative voltage applied thereto by the power supply device.

This causes the electric-field generating and catching member to be a negatively-charged electrode, thus making it possible to catch positively-charged volatile chemical substances.

The electronic apparatus of the present technology can be arranged, furthermore, so as to further include a power source device for generating a positive voltage, wherein the electric-field generating and catching member is connected selectively to either of the power supply devices and has a negative or positive potential in response to a negative or positive voltage applied thereto.

This makes it possible to switch between the polarities of the electric-field generating and catching member. Therefore, volatile chemical substances generated by the electronic apparatus can be efficiently caught by switching between the polarities of an applied voltage in accordance with the polarity of the volatile chemical substances.

The electronic apparatus of the present technology can be arranged, furthermore, so as to further include a catching filter, provided inside of the exhaust duct, which catches the volatile chemical substances.

This makes it possible to secondarily catch volatile chemical substances that were not caught by the electric-field generating and catching member. Therefore, passage of the volatile chemical substances out of the electronic apparatus can be further effectively inhibited.

A volatile chemical substance catching device includes: an electric-field generating and catching member for generating an electric field in an atmosphere, for attracting volatile chemical substances contained in the atmosphere to a surface thereof by the action of the electric field, and for catching the volatile chemical substances; and a connector via which a voltage is supplied to the electric-field generating and catching member from a power supply device that generates a high voltage.

This enables an arrangement that hardly suffers from aged deterioration in performance and can catch volatile chemical compounds such as VOCs and odors over a long period of time, in comparison with the conventional arrangement.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the present technology, provided such variations do not exceed the scope of the patent claims set forth below.

The invention claimed is:

1. An electronic apparatus inside of whose housing volatile chemical substances are generated, the electronic apparatus comprising:

a volatile chemical substance catching section, provided inside of the housing, which generates an electric field in an atmosphere, which attracts the volatile chemical substances contained in the atmosphere thereto by the action of the electric field, and which catches the volatile chemical substances, the volatile chemical substance catching section comprising:

a first electrode that is affixed to a flat inner surface of an exhaust duct of the electronic apparatus;

a second electrode disposed at a distance from the first electrode, the second electrode being positioned in the exhaust duct so as to squarely receive main air currents flowing through the exhaust duct; and a power supply that applies the same voltage to the first and second electrodes, wherein the volatile chemical substance catching section operates using only a single polarity voltage.

2. The electronic apparatus as set forth in claim 1, wherein the voltage applied to the first electrode causes the electrode to generate an electric field that attracts the volatile chemical substances contained in the atmosphere to the surface thereof.

3. The electronic apparatus as set forth in claim 1, further comprising an exhaust fan that causes gas inside of the housing to pass out of the housing, wherein the first electrode is located upstream of the exhaust fan with respect to a flow direction of air passing through the exhaust duct.

4. The electronic apparatus as set forth in claim 1, wherein the power supply generates a negative voltage, and wherein the first electrode has a negative potential in response to a negative voltage being applied thereto by the power supply.

5. The electronic apparatus as set forth in claim 1, wherein the power supply is capable of generating a positive voltage or a negative voltage, and wherein the power supply applies either a positive voltage or a negative voltage to the first electrode.

6. The electronic apparatus as set forth in claim 1, further comprising a catching filter, provided inside of the exhaust duct, which catches the volatile chemical substances.

7. The electronic apparatus as set forth in claim 6, wherein the second electrode is disposed at a distance from the first electrode and upstream from the catching filter in a flow direction of air passing through the exhaust duct.

8. An electronic apparatus inside of whose housing volatile chemical substances are generated, the electronic apparatus comprising:

a volatile chemical substance catching section, provided inside of the housing, which generates an electric field in an atmosphere, which attracts the volatile chemical substances contained in the atmosphere thereto by the action of the electric field, and which catches the volatile chemical substances, the volatile chemical substance catching section comprising:

a flat electrode that is affixed to a flat inner surface of an exhaust duct of the electronic apparatus and a power supply that applies a voltage to the electrode, wherein the volatile chemical substance catching section operates using only a single polarity voltage, and wherein the volatile chemical substance catching section operates to generate an electric field in an atmosphere and to attract the volatile chemical substances contained in the atmosphere without the use of a counter electrode having an electric charge opposite to the electric charge of the flat electrode.

* * * * *